US005295314A

United States Patent [19]

Moumdjian

[11] Patent Number: 5,295,314

[45] Date of Patent: Mar. 22, 1994

[54] SHOE WITH SOLE INCLUDING HOLLOW SPACE INFLATABLE THROUGH REMOVABLE BLADDER

[76] Inventor: Armenak Moumdjian, Nor Marash Street, Bourj-Hammud, Beirut, Lebanon

[21] Appl. No.: 949,166

[22] Filed: Sep. 22, 1992

Related U.S. Application Data

[60] Continuation-in-part of Ser. No. 710,769, Jun. 4, 1991, Pat. No. 5,199,191, which is a continuation-in-part of Ser. No. 608,570, Nov. 2, 1990, Pat. No. 5,112,560, which is a division of Ser. No. 295,438, Jan. 10, 1989, abandoned, which is a division of Ser. No. 74,765, Jul. 17, 1987, Pat. No. 4,845,861.

[30] Foreign Application Priority Data

May 23, 1992 [EP] European Pat. Off. ..... 92201478.2

[51] Int. Cl.[5] ..... A43B 13/18; A43B 13/20; A43B 13/00

[52] U.S. Cl. ..... 36/29; 36/25 R; 36/107; 36/76 R

[58] Field of Search ..... 36/25 R, 28, 29, 30 R, 36/35 B, 3 B, 32 R, 141, 102, 107, 12, 17 R, 17 PW, 108, 75 R, 76 R, 76 C, 31

[56] References Cited

U.S. PATENT DOCUMENTS

| | | | |
|---|---|---|---|
| 508,034 | 11/1893 | Moore | 36/29 |
| 1,010,187 | 11/1911 | Scott | 36/29 |
| 2,682,712 | 7/1954 | Owsen et al. | 36/107 |
| 3,120,712 | 2/1964 | Menken | 36/29 |
| 3,125,816 | 3/1964 | Gartner | 36/17 R |
| 4,008,530 | 2/1977 | Gager | 36/28 |
| 4,100,686 | 7/1978 | Sgarlato | 36/29 |
| 4,183,156 | 1/1980 | Rudy | 36/44 |
| 4,219,945 | 9/1980 | Rudy | 36/29 |
| 4,446,634 | 5/1984 | Johnson | 36/28 |
| 4,610,099 | 9/1986 | Signori | 36/29 |
| 4,615,126 | 10/1986 | Mathews | 36/25 R |
| 4,670,995 | 6/1987 | Huang | 36/29 |
| 4,722,131 | 2/1988 | Huang . | |
| 4,744,157 | 5/1988 | Dubner | 36/88 |
| 4,887,367 | 12/1989 | Mackness | 36/28 |
| 4,897,939 | 2/1990 | Harrington | 36/108 |
| 5,199,191 | 4/1993 | Moumdjian | 36/25 R |

*Primary Examiner*—Paul T. Sewell
*Assistant Examiner*—Marie D. Patterson
*Attorney, Agent, or Firm*—Herbert Dubno

[57] ABSTRACT

A shoe formed by an upper and a flat sole of a type having an air chamber made up of compartments, capable of being inflated by means of valves, the flat sole of which is provided with a raised perimetral edge. The sole receives the air chamber and is connected with a rigid countersole and upper by means of stitching, gluing or the like, there being also included in such flat sole a rigid layer. This combination provides a flexible cavity capable of allowing flat and parallel movement of the arch support of the shoe in relation to the outer sole.

6 Claims, 2 Drawing Sheets

SHOE WITH SOLE INCLUDING HOLLOW SPACE INFLATABLE THROUGH REMOVABLE BLADDER

This application is a continuation-in-part of copending application Ser. No. 07/710,769 filed 4 Jun. 1991 now U.S. Pat. No. 5,199,191, as continuation-in-part of then copending application Ser. No. 07/608,570 filed 2 Nov. 1990 (now U.S. Pat. No. 5,112,560 issued 12 May 1992) as division of then copending application Ser. No. 07/295,438 (now abandoned) filed 10 Jan. 1989 as division of then copending application Ser. No. 07/074,765 filed 17 Jul. 1987 (now U.S. Pat. No. 4,845,861 issued July 1989).

FIELD OF THE INVENTION

The object of this invention is a shoe provided with a cavity which can be inflated with compressed air to regulate the flexibility of the sole.

BACKGROUND OF THE INVENTION

It is known that of all the daily activities performed by people major importance is attached to comfort during walking, which is greatly influenced by the type of shoe worn by the user; in particular such comfort in walking is determined by the degree of flexibility characteristic of the sole of the shoe, which flexibility should differ for different needs such as, for example, sporting activities which necessitate rigid soles to restore the necessary force of reaction, for example when jumping, or the normal gait of an elderly person who needs greater softness to cushion the rebound sustained by the foot with each step on the ground.

There are also known certain developments intended to provide a solution to this problem and based either on the use of different materials capable of imparting higher or lower rigidity to the sole, or on the use of insoles with air chambers of various designs.

Such air insoles include that of Patent EP O 293 034. Earlier air insoles, however, may pose major disadvantages on being applied to a shoe, either because of the difficulty of insertion therein during a normal industrial processing cycle, or because of the basic impracticability of achieving correct regulation of the pressure in the air chamber without rendering the insole uncomfortable because it is either too deflated, and therefore superfluous, or too inflated, resulting in the foot being supported on hard surfaces which soon cause aching feet and an awkward gait.

OBJECT OF THE INVENTION

It is the object of this invention to provide an improved shoe having a sole of inflatable type in order to regulate the flexibility of such sole so as to modify the features of the shoe and make it suitable both for normal walking and for the practice of sporting activities.

The shoe should furthermore ensure maximum comfort and waterproofness under any conditions and should be capable of easy, repeatable and low-cost production.

SUMMARY OF THE INVENTION

Such problems are solved.

These objects are achieved, according to this invention by, a shoe formed by an upper and by a flat sole of the type comprising an air chamber made up of compartments, capable of being inflated by means of valves, in which the flat sole is provided with a raised perimetral edge to which are connected the air chamber, a rigid countersole and the upper by means of stitching, gluing or the like, there being also included in such flat sole a rigid layer this combination provides a flexible cavity capable of allowing flat and parallel relative movement of the arch support of the shoe in relation to the outer sole.

In a preferred embodiment of the shoe according to the invention, such compartmented air chamber is incorporated in the sole in a reversible manner, and furthermore such raised edge of the outer sole is provided with at least one through hole at right angles to the surface of the said edge.

Provision is also made for such rigid layer integral with the outer sole to be preferably included within the thickness of the said sole, albeit divided into two parts, comprising a front part and a rear part, articulated to one another by means of a transverse-axis hinge.

In the shoe according to the invention the rigid countersole is in turn divided into two parts, comprising a front part and a rear part, articulated to one another lengthwise by means of a transverse hinge, such front and rear parts being delimited peripherally by a raised edge capable of being made integral with the matching raised edge of the outer sole.

BRIEF DESCRIPTION OF THE DRAWING

Further features of the shoe according to the invention will become apparent from the following description with reference to the accompanying drawing, in which.

SPECIFIC DESCRIPTION

Figure 1:
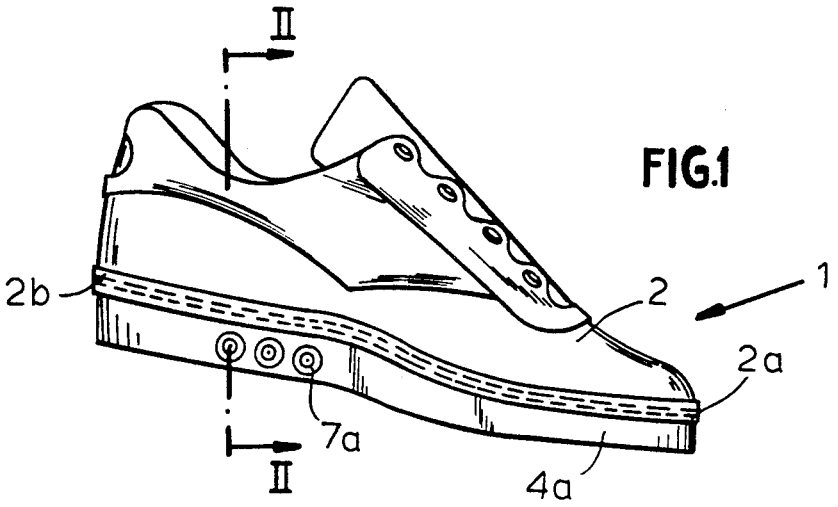
FIG. 1 is a perspective view of a shoe according to the invention.

As shown in the drawing, shoe 1 according to the invention consists of an upper part commonly known as an upper 2, the lower part of which is formed according to the right or left shape of the foot.

To such upper 2 is made integral, for example by stitching 2*a* or the like, a perimetral strip 2*b* made of the same material as used for upper 2, capable of being turned from top to bottom, and vice versa, around such line of stitching 2*a*, as will become more clearly apparent from the following.

The part of the shoe forming the sole is in turn formed of several parts connected with one another; more particularly consists of an outer sole 4 which has a surrounding vertical band 4*a* provided with holes 4*b* on a horizontal axis. In this outer sole 4 is furthermore included, using methods known per se, a thin layer 5 of rigid material capable of imparting greater rigidity to the said sole.

Figure 2:
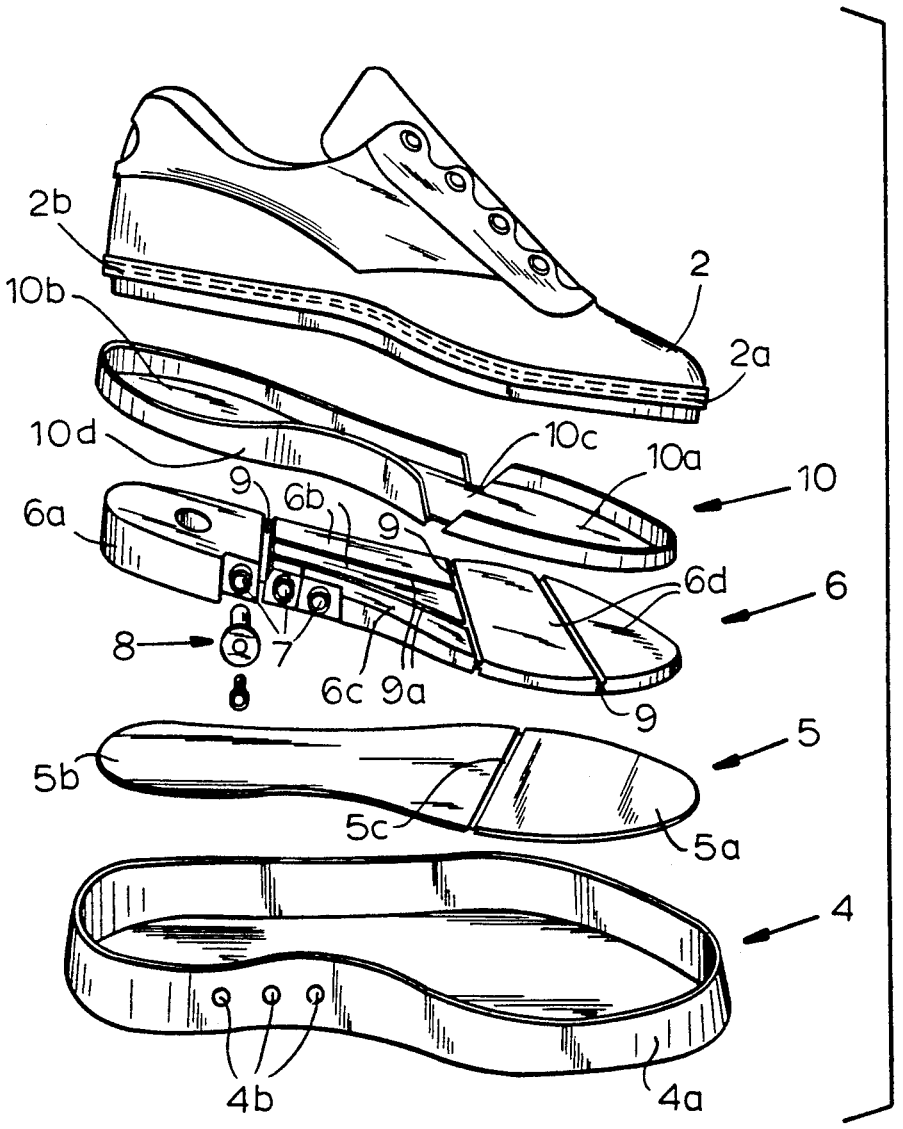
FIG. 2 is an exploded view of the shoe in FIG. 1.

Such layer 5 is divided into two parts, a front part 5*a* and a rear part 5*b*, which are articulated to one another by means of a transverse hinge 5*c* consisting of a thin strip of flexible material. The outer sole 4 is connected to an air chamber 6 suitably shaped (FIGS. 2 and 4) which, as shown in the figures, is preferably divided into three spaces capable of being inflated separately and corresponding respectively to heel area 6*a*, arch support area 6*b*, 6*c* and toe area 6*d*.

Figure 4:
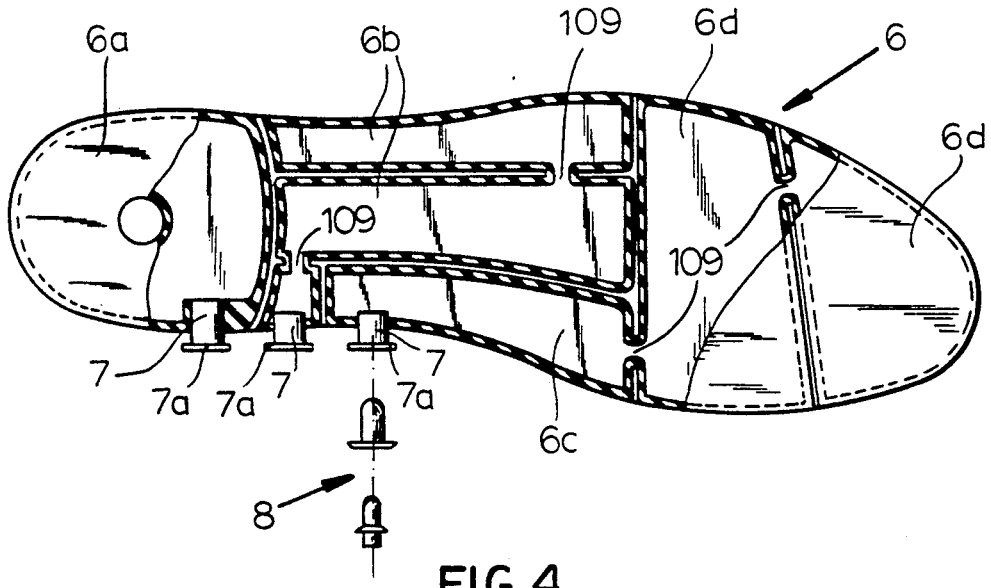
FIG. 4 is a plan view of the air cavity according to the invention.

Each of these spaces is then connected, by means of a perforated cylindrical chamber 7, to one-way valves 8 through which it is possible to pump into each space the volume of air needed to obtain the desired rigidity; in order to allow improved distribution of air in such spaces they are isolated from one another as illustrated in FIG. 4. More precisely heel 6*a* is independent, two spaces 6*b* of the arch support are connected to one another and a third space 6*c* of the arch support is connected to spaced 6*d* of the toe, such connection being carried out by means of connecting channels 109.

The spaces 6*a* and 6*d* are furthermore separated transversally from spaces 6*b* and 6*c* by thin-transverse, continuous, solid strips 9 made of the same material, acting as transverse-axis hinges around which such spaces are articulated to enable them to adapt to the different movements of the foot when walking. Likewise, spaces 6*b* and 6*c* of the arch support are divided by like strips 9*a* of material arranged longitudinally.

The air chamber 6 is connected with outer sole 4 by means of perforated cylinders 7 receiving valves 8, which are forced into holes 4*b* of edge band 4*a* until each circular edge flange 7*a* protrudes from holes 4*b*, causing the locking of air chamber 6 to sole 4.

Figure 3:
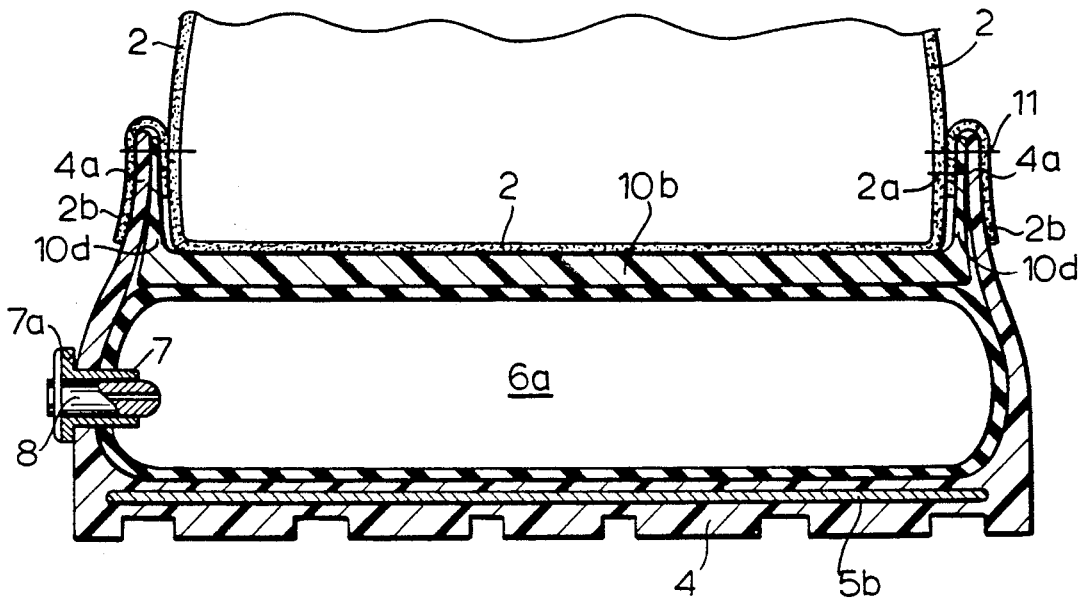
FIG. 3 is a sectional view of the shoe taken alongline III—III of FIG. 1.

As is apparent from FIG. 3, in the remaining sight of band 4*a* there is inserted a countersole 10 which is divided into two parts, front 10*a* and rear 10*b*, by means of a strip 10*c* of thin material forming a horizontal/transverse-axis hinge which allows articulation of the front part relative to the rear part in the manner already described for air chamber 6.

Countersole 10 is then completed by a surrounding vertical edge 10*d* (interrupted at the strip 10*c*) the height of which is such as to arrive substantially at the level of the upper free end of edge 4*a* of outer sole 4 (FIG. 3). Once upper 2 is assembled to the outer sole, completed in the manner described above, band 2*b* is turned down to overlap edge 4*a*, whereupon the shoe is made ready for final stitching 11.

Such final stitching not only makes upper 2 integral with outer sole 4, but also fixes in relation to the latter the assembly formed by air chamber 6 and countersole 10, thus making it possible for such assembly to function as a proper shock absorber having two fixed points: at the top, the final stitching, and at the bottom the outer sole and therefore the ground, the regulation of the stiffness of such shock absorber being achieved by the higher or lower internal pressure of the air chamber.

It should moreover be emphasized that the insertion of countersole 10 makes it possible to obtain uniform distribution of the pressure of the air chamber on the plan of upper 2, and therefore on the wearer's feet, which pressure would in the absence of the countersole be concentrated in much smaller surface areas which would be equivalent, in regard to the feet, to the presence of foreign bodies such as pebbles or the like inside the shoe.

Many alternatives may be introduced in the practical implementation of the constructional details without thereby departing from the scope of protection of this invention as described in the following claims; in particular many alternatives may be adopted to render sole 4 integral with upper 2 as an alternative to the method described with reference to the example in the drawing, depending on the type of model and of the materials used to manufacture the shoe.

I claim:

1. A shoe comprising:

a flat sole formed with a raised perimetral edge having at least one opening;

a rigid layer in said sole;

a compartmented air chamber received in said sole above said rigid layer and having a valve extending through said opening and allowing variable inflation of said air chamber;

a rigid countersole connected to said edge and disposed above said air chamber, said rigid countersole comprising a front part, a rear part, a transverse hinge articulating said front part and said rear part, and a raised edge extending all around said countersole but interrupted at said transverse hinge and being connected to said perimetral edge; and an upper received within said raised edges and secured thereto.

2. The shoe defined in claim 1 wherein said air chamber has a heel compartment, at least one toe compartment and a plurality of transversely separated longitudinal compartments between said toe compartment and said heel compartment, at least a plurality of said compartments being provided with respective valves enabling separate inflation thereof and extending through respective openings in said raised perimetral edge.

3. The shoe defined in claim 2 wherein said air chamber is removable received in said sole within said raised perimetral edge.

4. The shoe defined in claim 1 wherein said rigid layer is embedded in the thickness of said sole.

5. The shoe defined in claim 4 wherein said rigid layer is divided into a front part and a rear part articulated to one another by a flexible transverse hinge.

6. The shoe defined in claim 1 wherein said upper is formed with a strip turned over and raised edges and stitched thereto.

* * * * *